US011331683B2

(12) United States Patent
Keske et al.

(10) Patent No.: US 11,331,683 B2
(45) Date of Patent: May 17, 2022

(54) TECHNOLOGIES FOR FOAM FORMATION AND OUTPUT

(71) Applicant: Foam Supplies, Inc., Earth City, MO (US)

(72) Inventors: Todd Keske, Chesterfield, MO (US); Don Keim, O'Fallon, MO (US)

(73) Assignee: Foam Supplies, Inc., Earth City, MO (US)

( * ) Notice: Subject to any disclaimer, the term of this patent is extended or adjusted under 35 U.S.C. 154(b) by 532 days.

(21) Appl. No.: 16/501,114

(22) Filed: Feb. 26, 2018

(65) Prior Publication Data

US 2020/0055064 A1 Feb. 20, 2020

(51) Int. Cl.
*B05B 7/04* (2006.01)
*B05B 7/00* (2006.01)

(52) U.S. Cl.
CPC ..... *B05B 7/04* (2013.01); *B05B 7/0018* (2013.01)

(58) Field of Classification Search
CPC ..... B05B 7/04; B05B 7/0018; B05B 7/1209; B05B 7/2497; B05B 7/0025; B05B 7/0408
See application file for complete search history.

(56) References Cited

U.S. PATENT DOCUMENTS 3,366,288 A * 1/1968 Goldschein ..... A47L 11/4011 222/504
3,799,403 A * 3/1974 Probst ..... B29B 7/761 222/135
4,170,440 A * 10/1979 Gusmer ..... B29B 7/603 417/426
4,199,303 A * 4/1980 Gusmer ..... B05B 7/0018 137/101.21
4,321,021 A * 3/1982 Pauliukonis ..... F04B 17/042 222/340
5,318,208 A * 6/1994 van der Wal ..... B65D 83/262 222/402.13
5,960,701 A * 10/1999 Reese ..... B67D 1/0039 222/135
6,434,353 B1 * 8/2002 Kwak ..... G03G 15/104 399/238
6,691,729 B2 * 2/2004 Takeda ..... F16K 1/305 137/601.14
6,715,506 B1 * 4/2004 Ikushima ..... H01L 51/0004 137/14
9,038,929 B1 * 5/2015 Commette ..... B05B 7/2497 239/526
9,421,560 B2 * 8/2016 Conrad ..... B05B 1/005
2008/0006658 A1 * 1/2008 Bolyard ..... F16K 27/003 222/504
2015/0017327 A1 * 1/2015 Myers ..... B05B 12/002 427/207.1

(Continued)

*Primary Examiner* — Donnell A Long
(74) *Attorney, Agent, or Firm* — Stinson LLP

(57) ABSTRACT

A foam output device, such as a dispenser, a gun, a turreted cannon, a hose adapter, an aerosol can, or others. The foam output device includes a valve configured to switch between a first mode and a second mode. The valve is configured to simultaneously receive a plurality of compositions and a fluid during the first mode such that the compositions and the fluid are able to react with each other within the valve to form a foam thereby. The valve is configured to prevent the compositions and the fluid from reacting with each other in the valve during the second mode.

23 Claims, 11 Drawing Sheets

(56) References Cited

U.S. PATENT DOCUMENTS

| | | | | |
|---|---|---|---|---|
| 2015/0085601 | A1* | 3/2015 | Hammerlund | B29B 7/7447 366/160.1 |
| 2015/0367357 | A1* | 12/2015 | Humpal | B05B 12/12 239/1 |
| 2016/0067735 | A1* | 3/2016 | Bourbeau | B05C 11/1036 222/39 |
| 2018/0043380 | A1* | 2/2018 | Gantenbein | B05B 7/0408 |
| 2019/0022683 | A1* | 1/2019 | Donaldson | B05B 7/1693 |
| 2019/0024824 | A1* | 1/2019 | Bolea | F16L 11/086 |
| 2019/0291122 | A1* | 9/2019 | Cvetezar | E02D 35/005 |

* cited by examiner

TECHNOLOGIES FOR FOAM FORMATION AND OUTPUT

TECHNICAL FIELD

This disclosure relates to foam formation and output.

BACKGROUND

There is a desire for a technology to enable a formation of a foam from a plurality of compositions and an output of the foam, where the formation and the output occur via a single device. Since such technology does not exist, this disclosure enables such technology.

SUMMARY

According to an embodiment of this disclosure, a device comprises: a dispenser including a valve configured to switch between a first mode and a second mode, wherein the valve is configured to simultaneously receive a plurality of compositions and a fluid during the first mode such that the compositions and the fluid are able to react with each other within the valve to form a compound thereby, wherein the valve is configured to prevent the compositions and the fluid from reacting with each other in the valve during the second mode.

According to an embodiment of this disclosure, a method comprises: directing a plurality of compositions and a fluid into a chamber of a housing positioned within a dispenser such that the compositions and the fluid are able to react with each other within the chamber to form a compound; and outputting the compound from the chamber.

Note that this disclosure is embodied in various forms illustrated in a set of accompanying illustrative drawings and variations are contemplated as being a part of this disclosure, limited only by a scope of various claims recited below.

BRIEF DESCRIPTION OF DRAWINGS

The set of accompanying illustrative drawings shows various example embodiments of this disclosure. Such drawings are not to be construed as necessarily limiting this disclosure. Like numbers and/or similar numbering scheme can refer to like and/or similar elements throughout.

DETAILED DESCRIPTION

Generally, this disclosure discloses a foam output device, such as a dispenser, a gun, a turreted cannon, a hose adapter, an aerosol can, or others. The foam output device includes a valve configured to switch between a first mode and a second mode. The valve is configured to simultaneously receive a plurality of compositions and a fluid during the first mode such that the compositions and the fluid are able to react with each other within the valve to form a foam thereby. The valve is configured to prevent the compositions and the fluid from reacting with each other in the valve during the second mode. However, note though that this disclosure is now described more fully with reference to the set of accompanying illustrative drawings, in which example embodiments of this disclosure are shown. This disclosure can be embodied in many different forms and should not be construed as necessarily being limited to the example embodiments disclosed herein. Rather, the example embodiments are provided so that this disclosure is thorough and complete, and fully conveys various concepts of this disclosure to those skilled in a relevant art.

Figure 1:
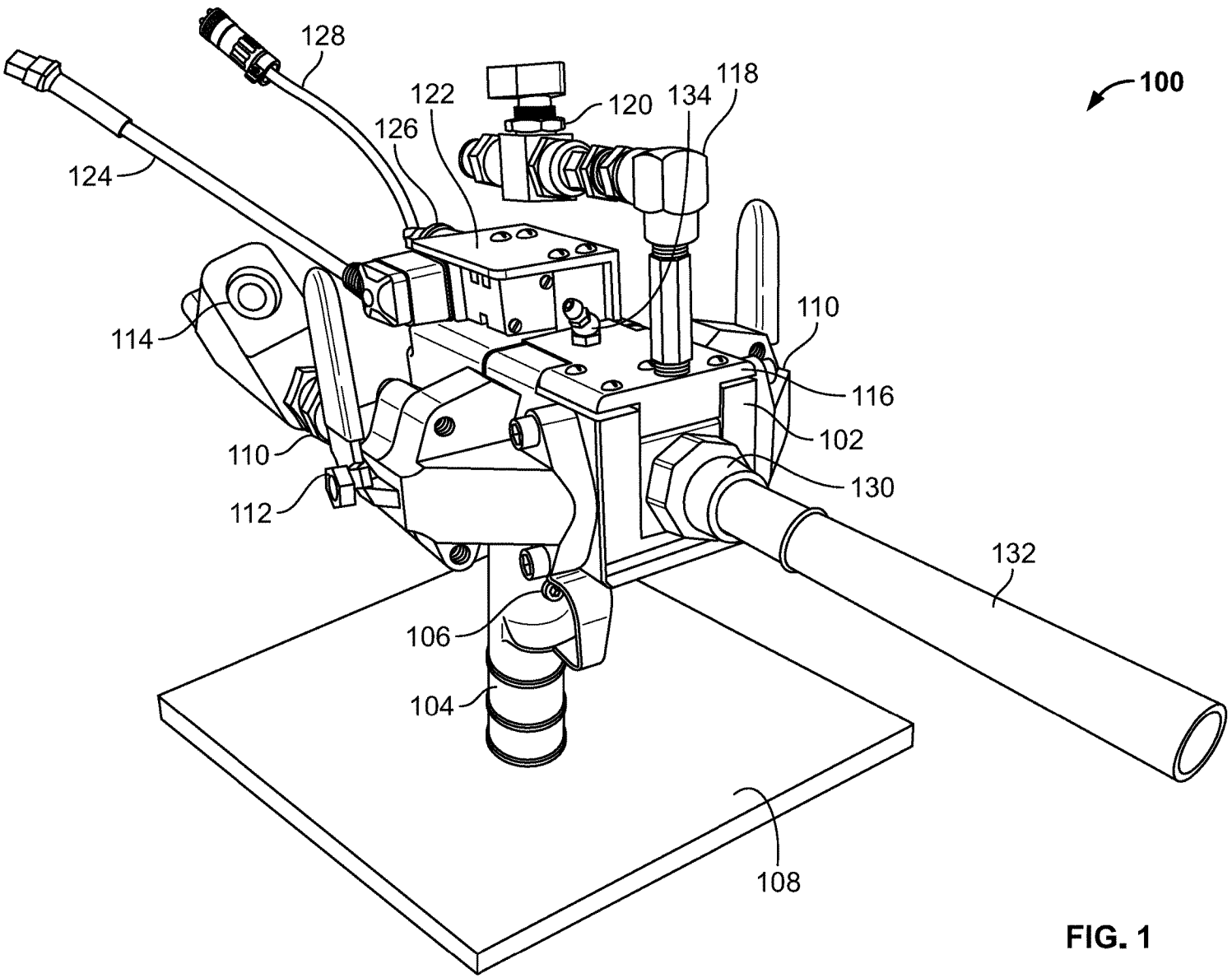
FIG. 1 illustrates a perspective view of an embodiment of a foam dispenser or gun according to this disclosure.
Figure 2:
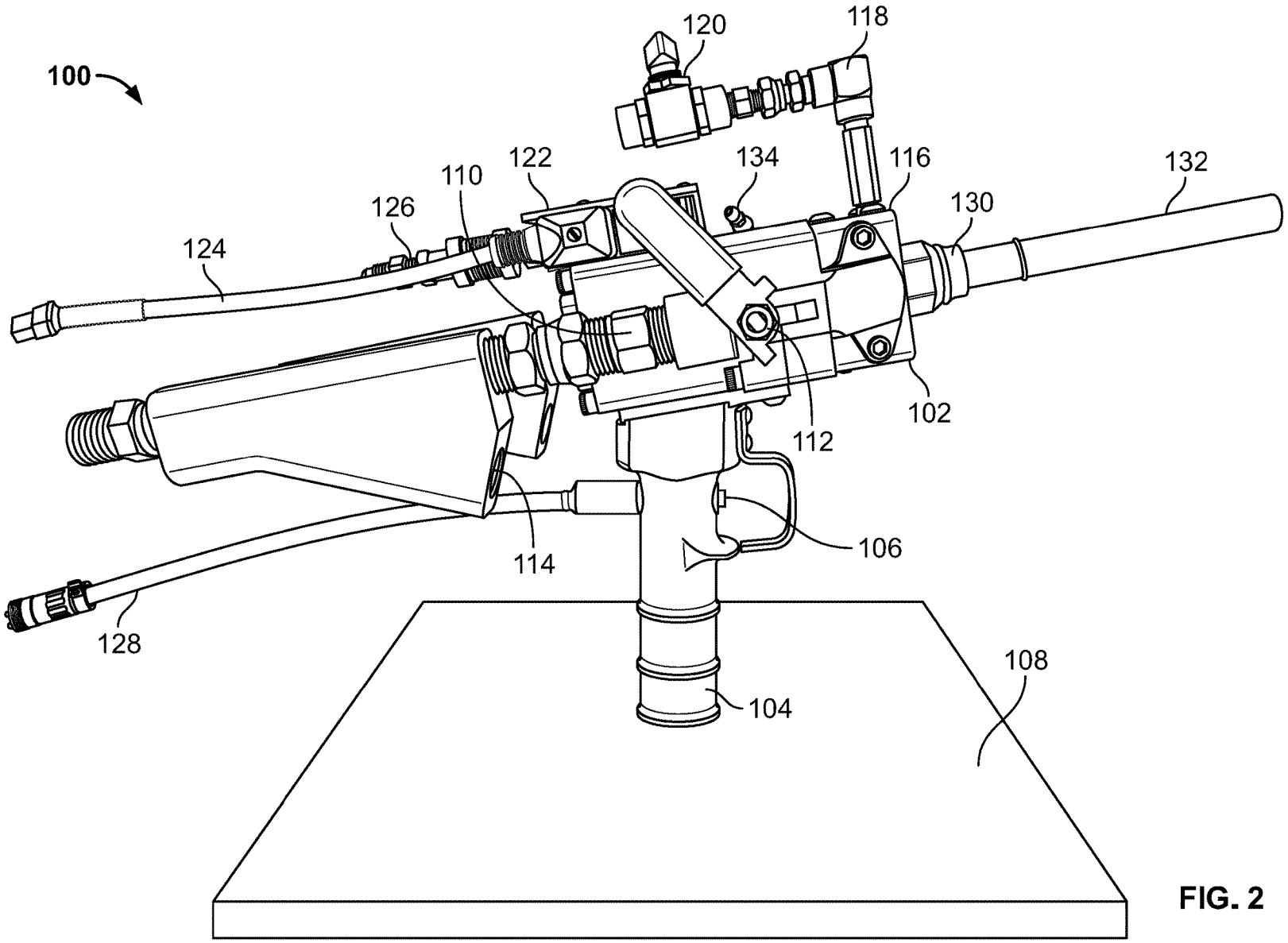
FIG. 2 illustrates a right side view of an embodiment of a foam dispenser or gun according to this disclosure.
Figure 3:
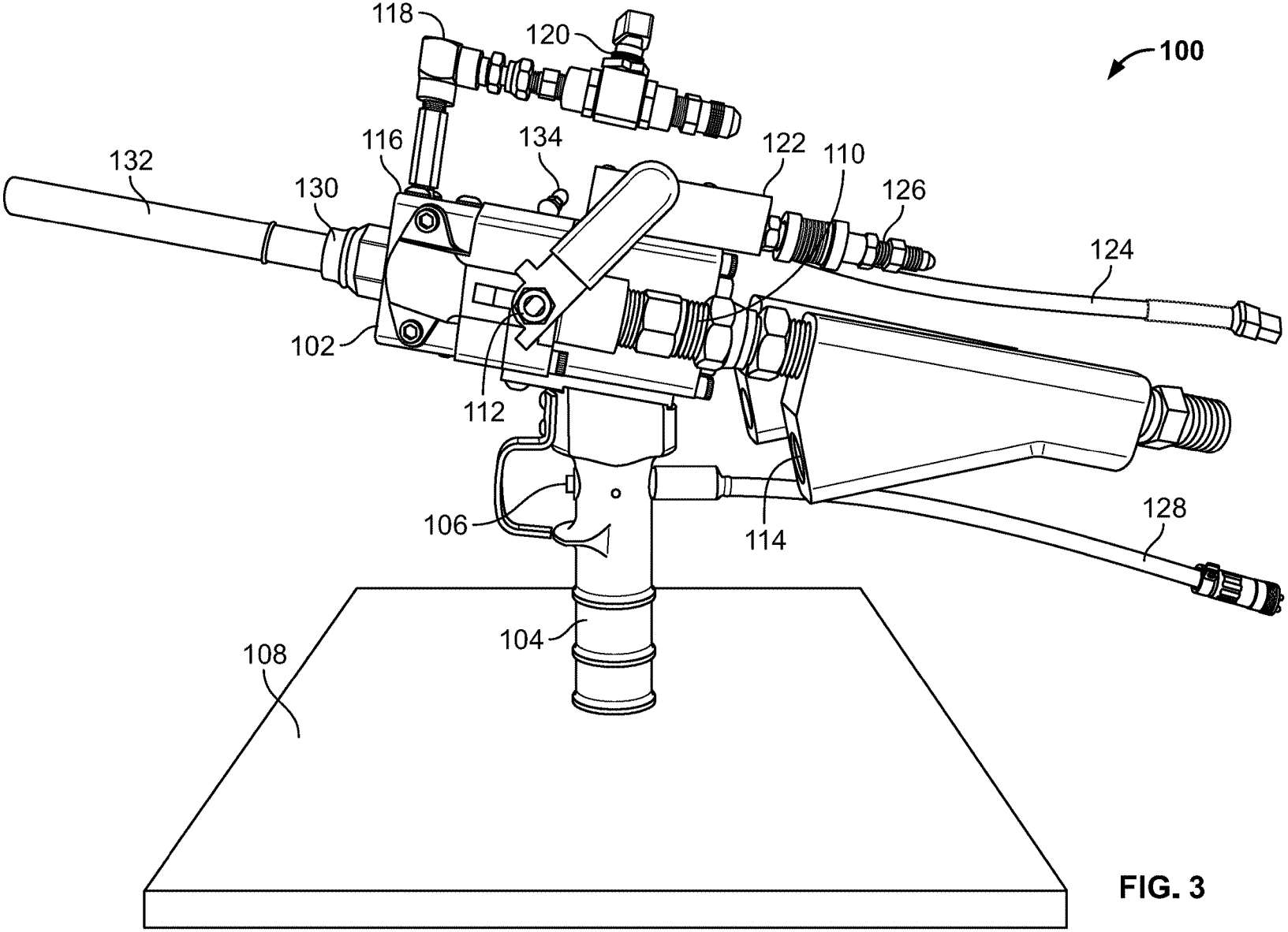
FIG. 3 illustrates a left side view of an embodiment of a foam dispenser or gun according to this disclosure.
Figure 4:
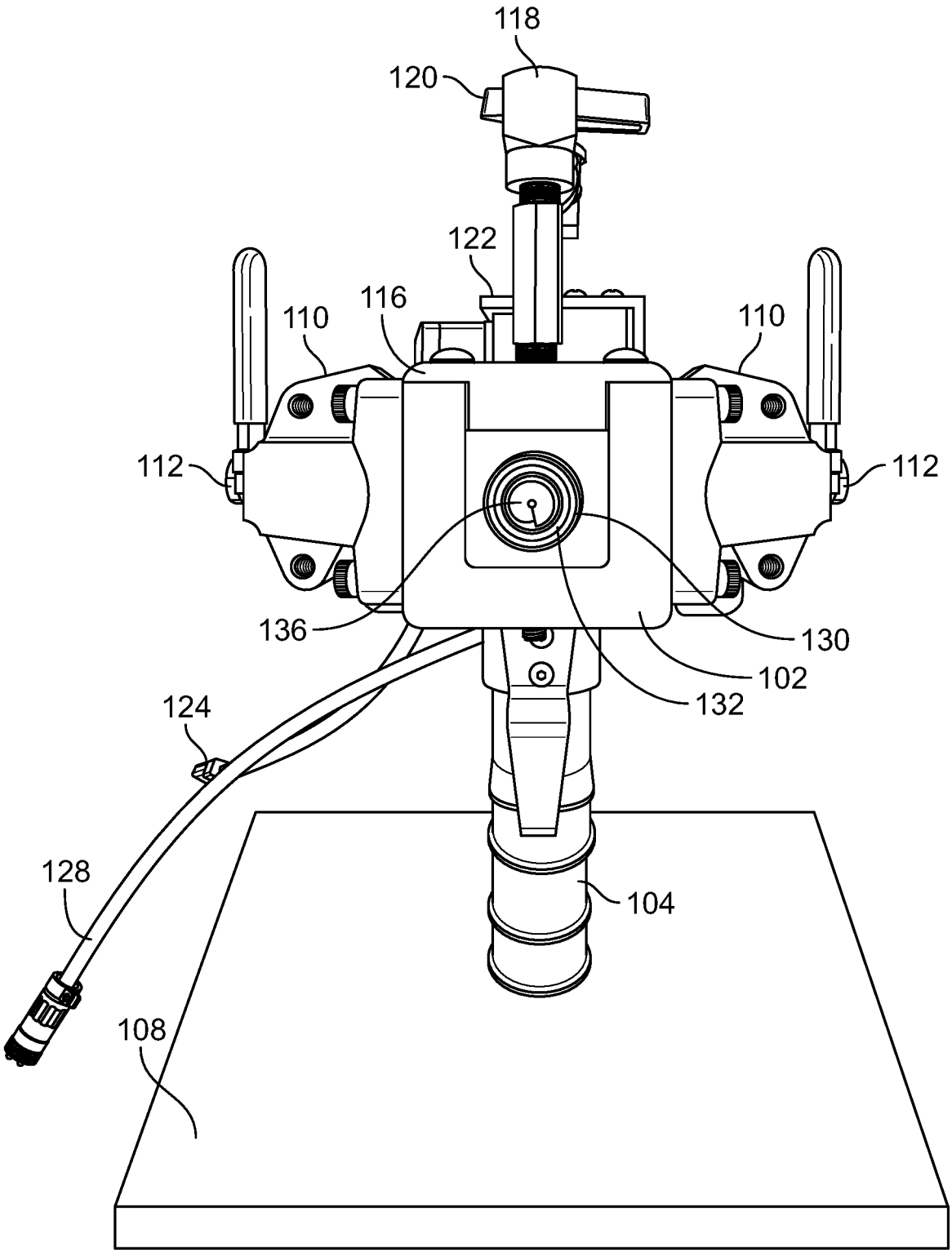
FIG. 4 illustrates a front view of an embodiment of a foam dispenser or gun according to this disclosure.
Figure 5:
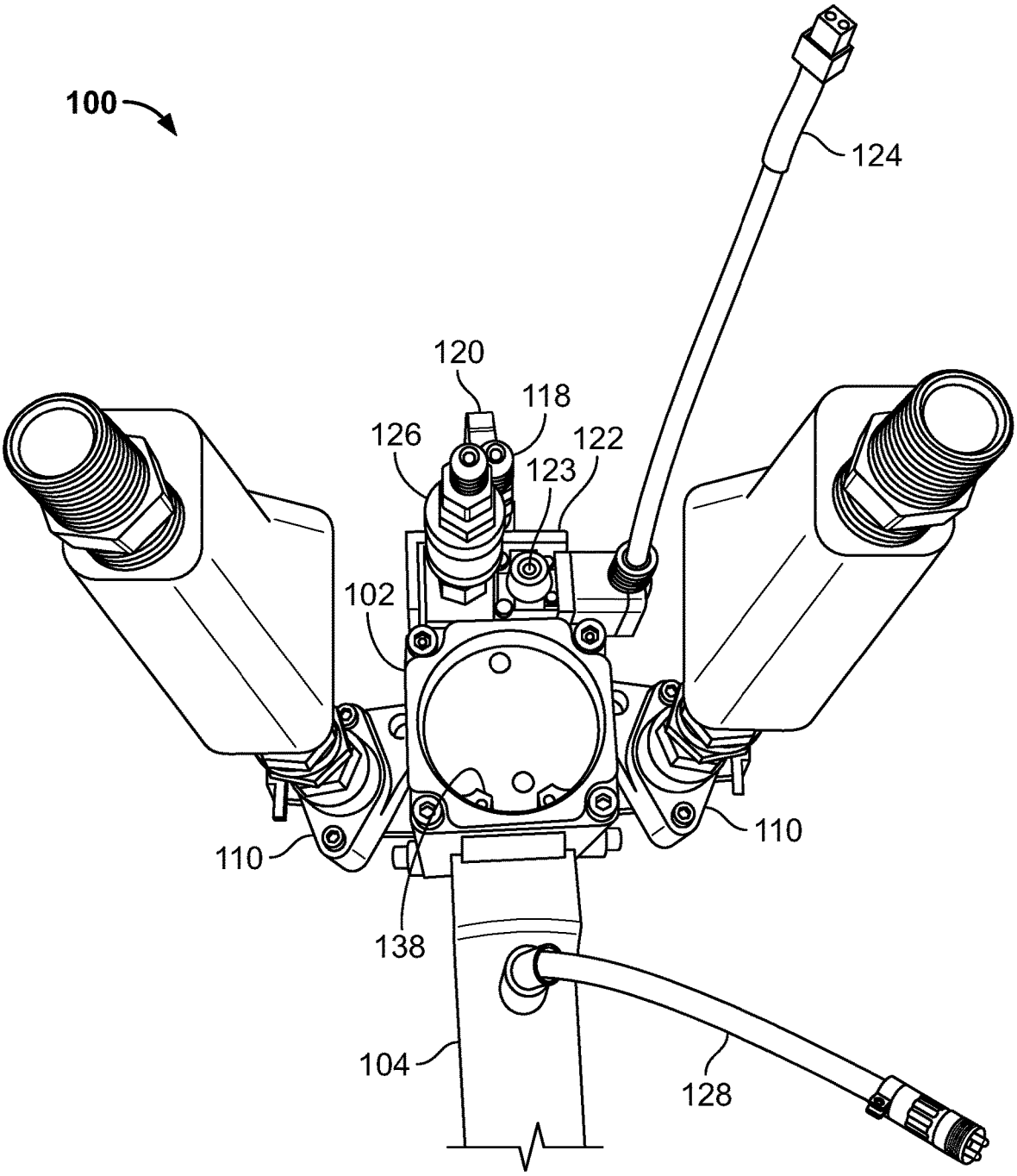
FIG. 5 illustrates a back view of an embodiment of a foam dispenser or gun according to this disclosure.

FIG. 1 illustrates a perspective view of an embodiment of a foam dispenser or gun according to this disclosure. FIG. 2 illustrates a right side view of an embodiment of a foam dispenser or gun according to this disclosure. FIG. 3 illustrates a left side view of an embodiment of a foam dispenser or gun according to this disclosure. FIG. 4 illustrates a front view of an embodiment of a foam dispenser or gun according to this disclosure. FIG. 5 illustrates a back view of an embodiment of a foam dispenser or gun according to this disclosure. In particular, a foam dispenser or gun 100 includes a body 102 and a handle 104. The body 102 is cuboid, but can be shaped differently, such as a cube, an ovoid, or others. As shown in FIG. 5, the body 102 hosts a circlip or retaining ring 138 that rests therein and configured to engage with the body 102 to control a physical and optical access thereto, and specifically to a solenoid valve that controls movement of a plunger that enables dispensing of a foam, as described herein. The handle 104 is coupled to the housing 102, such as via fastening, mating, or others, such that the handle 104 supports the body 102 in a pistol grip manner. As shown in FIG. 3, the handle 104 includes a button 106 or another user input device, whether mechanical or electronic, such as a trigger or others, which may be coupled to a timer for the button 106, with the body 102 or a remote device containing the timer for a time operation of the dispenser or gun 100. The handle 104 is coupled to a cable 128 that is bi-pin, but other configurations are possible, as known to skilled artisans. The cable 128 is configured to direct an electrical power to the button 106, such as when the cable 128 is coupled to a power source, such as a generator, a battery, an electrical outlet, or others.

In one or more embodiments, the handle 104 is coupled, such as via fastening, mating, or others, to a platform 108 such that the button 106 is positioned between the body 102 and the platform 108. For example, such form of coupling can enable the handle 106 to rotate sideways between 0 and 360 degrees or tilt up and down with respect to the platform 108 to enable selective pointing of the body 102. The platform 108 is solid and square in perimeter, but can be shaped differently, such as oval, perforated, or others.

The foam dispenser or gun 100 also includes a plurality of tube assemblies 110, a plurality of valves 112, and a plurality of valves 114. The tube assemblies 110 are coupled to the body 102, such as via fastening, mating, or others, such that the tube assemblies 110 are external to the body 102 and the body 102 is positioned between the tube assemblies 110, although variations on this positioning configuration are possible based on use context. The tube assemblies 110 are configured to couple, such as via fastening, mating, or others, to a plurality of sources, whether local or remote, such as containers, canisters, chambers, pumps, compressors, or others, of a plurality of chemical compositions in a fluid form, whether liquid or gas, and conduct the chemical compositions in the fluid form to the body 102. with the chemical compositions being different from each other in composition, such as chemistry, or fluid properties, such as pressure, temperature, or others. For example, the chemical compositions can include isocyanates, polyol, flame retardants, amine catalysts, or others. For example, the tube assemblies 110 can operate as Side A and Side B in a polyurethane foam formation, where a tube assembly 110 of the Side A directs isocyanates and a tube assembly of the Side B conducts polyol. As such, the tube assemblies 110 host the valves 112 and the valves 114 external to the body 102. The valves 112 are configured to enable independent activation/deactivation of flow of the chemical compositions, while the valves 114 are configured to enable independent flow rate adjustments of the chemical compositions. Although the valves 112 operate via handles, in other embodiments, the valves 112 operate in different ways, such as dials, keys, sliders, buttons, knobs, or others, whether actuated or manual. Likewise, although the valves 114 operate via keys, in other embodiments, the valves 114 operate in different ways, such as handles, dials, sliders, buttons, knobs, or others, whether actuated or manual.

The body 102 contains an interior portion that receives the chemical compositions, as further described below. The interior portion is covered by a cover 116 that is coupled to the body 102, such as via fastening, mating, or others, such that the cover 116 is selectively removable therefrom, such as manually or others, in order to provide a physical and optical access to the interior portion. The cover 116 is T-shaped in cross-section and in perimeter, but can be shaped differently, whether in cross-section or in perimeter, such as via an L-shape, a U-shape, or others. The cover 116 hosts an inlet 134 configured to receive a fluid and direct the fluid into the interior portion. For example, the inlet 134 is configured to receive a lubricant, such as oil, grease, or others, and direct the lubricant into the interior portion.

The foam dispenser or gun 100 additionally includes an L-shaped tube assembly 118 and a valve 120. The L-shaped tube assembly 118 is coupled to the cover 116, such as via fastening, mating, or others, such that the L-shaped tube assembly 118 is external to the body 102 and positioned between the tube assemblies 110, although variations on this positioning configuration are possible based on use context. The L-shaped tube assembly 118 is configured to couple, such as via fastening, mating, or others, to a source, such as a container, a pump, a compressor, or others, of a fluid, whether liquid or gas, and conduct the fluid to the body 102 and then into the interior portion for engagement with the chemical compositions, as further described below. For example, the fluid can include a liquid, such as water or others, or the fluid can include a gas, such as air, nitrogen, or others. As such, L-shaped tube assembly 118 hosts the valve 120 external to the body 102. The valve 120 is configured to enable independent activation/deactivation of flow of the fluid independent of the valves 112 and the valves 114. Although the valve 120 operates via a knob, in other embodiments, the valve 120 operates in different ways, such as a handle, a dial, a key, a slider, a button, or others, whether actuated or manual. Further, in some embodiments, the L-shaped tube assembly 118 is shaped differently, such as rectilinearly, arcuate, sinusoidal, or others.

In some embodiments, the L-shaped tube assembly 118 is configured to provide a fixed rate of flow of the fluid with valve 120 providing on or off control of the fluid. In some embodiments, the L-shaped tube assembly 118 is configured to provide an adjustable rate of flow of the fluid with valve 120 or an additional valve providing for control and adjustment of the rate of flow of the fluid.

The foam dispenser or gun 100 further includes a solenoid valve 122, a cable 124, and a tube assembly 126. The solenoid valve 122 rests on or within the body 102, such as within the interior portion, as described above, and between the tube assemblies 110 and between the handle 104 and the L-shaped tube assembly 118. The solenoid valve 122 is powered via the cable 124 conducting an electric power thereto, such as when the cable 124 is coupled to a power source, such as a generator, a battery, an electrical outlet, or others. The cable 124 is bi-pin, but other configurations are possible, as known to skilled artisans. The solenoid valve 122 also includes an override input device 123 in proximity of the cable 124, such as a button or others, to enable an override function of the solenoid valve 122, which is enabled via pushing to hold the override input device 123, with a default setting being closed and pushing the override input device 123 opens the solenoid valve 122 to release a fluid from the solenoid valve. The release of the fluid from the solenoid valve 122 provides for movement of a plunger to prevent dispensing of foam, as described herein. The solenoid valve 122 is coupled to the tube assembly 126, such as via fastening, mating, or others, such that the solenoid valve 122 is in fluid communication therewith and thereby feeds the fluid, whether a liquid or a gas, into the solenoid valve 122 to operate a mixing valve within the body 102, as further described below. For example, the fluid can include a liquid, such as water or others, or the fluid can include a gas, such as air, nitrogen, or others. As such, when a user operates the button 106 based on the cable 128, the solenoid valve 122 operates based on the cable 124 and the tube assembly 126, with the tube assembly 126 feeding the fluid into the solenoid valve 122.

The foam dispenser or gun 100 also includes a nut 130, a barrel 132, and an auger 136, as shown in FIG. 4. The nut 130 is rigid, but can be flexible. The nut 130 is diametrically tapered in shape, such as a funnel shape or others, but can be shaped differently, such as a right circular cylinder or others. The barrel 132 is rigid and longitudinally tubular, whether transparent, translucent, or opaque, but can be flexible. The barrel 132 includes a tapered end portion proximal to the body 102 and proximal to the nut 130. As such, the nut 130 is fastened to the body 102, as further described below, and the tapered end portion of the barrel 132 physically engages the nut 130 due to difference in diameter such that the barrel 132 is unable to be pulled out or fall out from the nut 130. Consequently, the barrel 132 extends through the nut 130 and past the nut 130 in a direction away from the body 102. The barrel 132 contains the auger 136 which longitudinally extends within the barrel 132 in a spiraling manner in a direction away from the body 102. The auger 136 avoids extending into the body 102 and is self-propelled, as further described below.

In one mode of operation, the tube assemblies 110 direct the chemical compositions into the body 102, while the L-shaped tube assembly 118 directs the fluid into the body 102. Within the body 102, when the mixing valve within the body 102 is activated, the chemical compositions and the fluid are selectively exposed to each other such that the chemical compositions and the fluid are able to react with each other within the body 102 to form a foam thereby. As such, the foam is directed for output via the barrel 132 via the auger 136 being self-propelled via a pressure resulting from the foam being directed to the auger 136 based on the chemical compositions being selectively sourced via the tube assemblies 110 and the fluid being selectively sourced from the L-shaped tube assembly 118.

Figure 6:
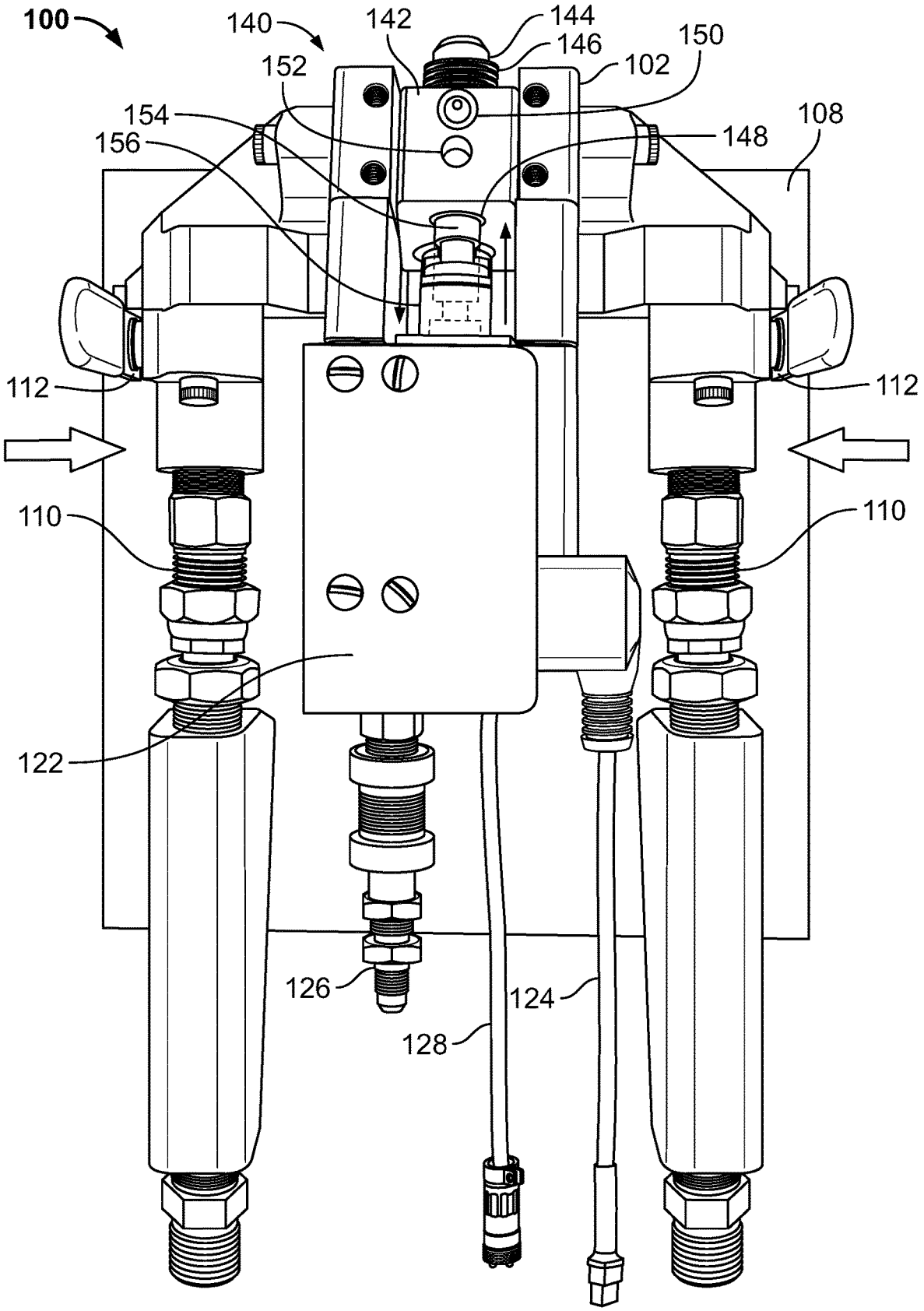
FIG. 6 illustrates a top view of an embodiment of a foam dispenser or gun according to this disclosure.

FIG. 6 illustrates a top view of an embodiment of a foam dispenser or gun according to this disclosure. In particular, as explained above, the body 102 contains the interior portion that receives the chemical compositions and the fluid. As illustrated in FIGS. 1-5, the interior portion is covered by the cover 116 that is coupled to the body 102, such as via fastening, mating, or others, such that the cover 116 is selectively removable therefrom, such as manually or others, in order to provide the physical and optical access to the interior portion. However, FIG. 6 illustrates the cover 116 selectively removed from the body 102 such that the physical and optical access to the interior portion of the body 102 is granted. Resultantly, as illustrated in FIG. 6, the body 102 houses a mixing valve 140 within the interior portion thereof.

The mixing valve 140 includes a housing 142 and a plunger 154. The housing 142 is positioned within the interior portion such that the housing 142 is in fluid communication with the tube assemblies 110 in order to simultaneously receive the chemical compositions from the tube assemblies 110, which direct the chemical compositions to the housing 142. Likewise, the housing 142 is positioned within the interior portion such that the housing 142 is in fluid communication with the L-shaped tube assembly 118 in order to receive the fluid from the L-shaped tube assembly 118, which directs the fluid to the housing 142. Accordingly, the housing 142 is able to simultaneously receive the chemical compositions and the fluid. Note that although the housing 142 is cuboid in shape, in other embodiments, the housing 142 can be shaped differently, such as a cube, a pyramid, a wedge, a sphere, an ellipsoid, an ovoid, or others. For example, the housing 142 can be shaped as a polyhedron.

The housing 142 has a tube 144 longitudinally extending away therefrom in a direction opposite from the tube assembly 126, with the tube 144 being offset and not co-aligned with the tube assembly 126, although variations on this configuration are possible, such as no offset between the tube 144 and the tube assembly 126 and co-alignment of the tube 144 and the tube assembly 126 or others. The tube 144 is unitary with the housing 142, which may include a material common to the tube 144 and the housing 142, such as plastic, metal, rubber, or others, but in other embodiments, the tube 144 is assembled with the housing 142, such as via fastening, mating, adhering, or others. The tube 144 is longitudinally rectilinear, but in other embodiments, the tube 144 is longitudinally non-rectilinear, such as sinusoidal, arcuate, pulsating, zigzag, or others. The tube 144 has a circular cross-section, but in other embodiments, the tube 144 has a cross-section that is shaped differently, such as polygonal or others. The tube 144 further includes a tapered end portion distal to the housing 102, but in other embodiments, the tube 144 includes a non-tapered end portion distal to the housing 102. The tube 144 also hosts a threaded portion 146, whether right handed or left handed, of any angle or pitch, whether continuous or discontinuous. The threaded portion 146 can be proximal, medial, or distal to the housing 142.

The housing 142 defines an interior chamber 148 that is in fluid communication with the tube 144, the tube assemblies 110, and the L-shaped tube assembly 118. The interior chamber 148 is shaped as a right circular cylinder, but in other embodiments, the interior chamber 148 is shaped differently, such as a cube, a cuboid, a wedge, or others. The interior chamber 148 has a smooth inner surface, but in other embodiments, the interior chamber 148 has a rough inner surface.

The housing 142 defines a fluid channel 150 that is in fluid communication with the interior chamber 148 and the L-shaped assembly 118 when the cover 116 is coupled to the body 102. The fluid channel 150 is rectilinear and shaped as a right circular cylinder, but in other embodiments, the fluid channel 150 is shaped differently, such as a cube, a cuboid, a wedge, a sinusoid, an arc, or others. The fluid channel 150 has a smooth inner surface, but in other embodiments, the fluid channel 150 has a rough inner surface.

The housing 142 also defines an upper well 152 such that the fluid channel 150 is positioned between the tube 144 and the upper well 152, although this configuration can vary. The upper well 152 is configured to receive a projection, such as a rectilinear post or others, from the cover 116 such that the housing 142 is secured within the interior portion of the body 102, such as via mating therewith or others. For example, the upper well 152 can receive the projection slidably, snugly, rotationally, or others. The upper well 152 is rectilinear and shaped as a right circular cylinder, but in other embodiments, the upper well 152 is shaped differently, such as a cube, a cuboid, a wedge, a sinusoid, an arc, or others. As such, the projection is configured to be inserted into the upper well 152 to secure, lock, or otherwise minimize movement of the housing 142 within the body 102.

The plunger 154 includes a disc or torus shaped base, a rectilinear stem, and a cylindrical portion, with the rectilinear stem spanning between the disc or torus shaped base and the cylindrical portion. In other embodiments, the plunger 154 is shaped differently, such as T-shaped, H-shaped, Y-shaped, J-shaped, C-shaped, U-shaped, I-shaped, or others, whether unitary or as an assembly. The plunger 154 is positioned within a casing 156 and has a first end portion and a second end portion, where the first end portion opposes the second end portion, with the cylindrical portion including the first end portion and with the disc or torus shaped base including the second end portion. The casing 156 is positioned within the interior portion of the body 102 between the tube assemblies 110 and between the housing 142 and the solenoid valve 122. The first end portion is proximal to the interior chamber 148. The second end portion is distal to the interior chamber 148. The first end portion is configured to move longitudinally within the interior chamber 148, such as snugly, slidably, rotationally, or others, and in some embodiments, the first end portion is configured to move outside the interior chamber 148. The second end portion is coupled to the solenoid valve 122, such as via fastening, mating, adhering, or others, such that the solenoid valve 122, based on the tube assembly 126, can actuate the plunger 154 via the second end portion in a first direction to a first position within or outside the interior chamber 148 and in a second direction to a second position within the interior chamber 148. In some embodiments, the solenoid valve 122 is unitary with the plunger 154. Accordingly, the plunger 154 is configured to move between the first position and the second position, as actuated via the solenoid valve 122 in opposing directions illustrated by opposing arrows shown between the housing 142 and the solenoid valve 122 in FIG. 6. Therefore, the mixing valve 140 is configured to switch between a first mode and a second mode, where the plunger 154 is at the first position in the first mode and the plunger 154 is at the second position in the second mode.

In the first mode, the solenoid valve 122, as switchably activated or deactivated via the button 106, actuates the plunger 154 such that the plunger 154 is sufficiently un-deployed, in a direction away from the tube 144 and towards the solenoid valve 122, in the interior chamber 148 to enable the tube assemblies 110 to be in fluid communication with the interior chamber 148 and the chemical compositions to be directed via the tube assemblies 110 into the interior chamber 148. Similarly, the plunger 154 is sufficiently un-deployed, in a direction away from the tube 144 and towards the solenoid valve 122, in the interior chamber 148 to enable the L-shaped tube assembly 118 to be in fluid communication with the interior chamber 148 via the fluid channel 150 as the cover 116 is coupled to the body 102 and the fluid is directed via the L-shaped tube assembly 118 into the interior chamber 148 via the fluid channel 150 as the cover 116 is coupled to the body 102. Resultantly, the mixing valve 140 is configured to simultaneously receive the chemical compositions and the fluid in the interior chamber 148 during the first mode such that the chemical compositions and the fluid are able to react with each other in the interior chamber 148 and mix with each other within the interior chamber 148 to form a foam thereby. As such, when the barrel 132 extends through the nut 130 and the nut 130 is fastened onto the tube 144 via the threaded portion 146, the foam, through pressure of the chemical compositions from the tube assemblies 110, the fluid from the L-shaped tube assembly 118, and the fluid in the interior chamber 148, is directed into the tube 144 and then into the barrel 132. The auger 136 is thereby self-propelled via the foam forcibly engaging with the auger 136 in the barrel 132 through pressure of the chemical compositions and the fluid in the interior chamber 148. In some embodiments, the auger 136 is powerably driven.

In the second mode, the solenoid valve 122, as switchably activated or deactivated via the button 106, actuates the plunger 154 such that the plunger 154 is sufficiently deployed, in a direction towards the tube 144 and away from the solenoid valve 122, in the interior chamber 148 to block the tube assemblies 110 from being in fluid communication with the interior chamber 148 and prevent the chemical compositions from being directed via the tube assemblies 110 into the interior chamber 148. Similarly, the plunger 154 is sufficiently deployed, in a direction towards the tube 144 and away the solenoid valve 122, in the interior chamber 148 to block the L-shaped tube assembly 118 from being in fluid communication with the interior chamber 148 via the fluid channel 150 and prevent the fluid from being directed via the L-shaped tube assembly 118 into the interior chamber 148 via the fluid channel 150, as the cover 116 is coupled to the body 102. Resultantly, the mixing valve 140 is configured to prevent the chemical compositions and the fluid from reacting with each other and mixing with each other in the interior chamber 148 during the second mode.

Figure 7:
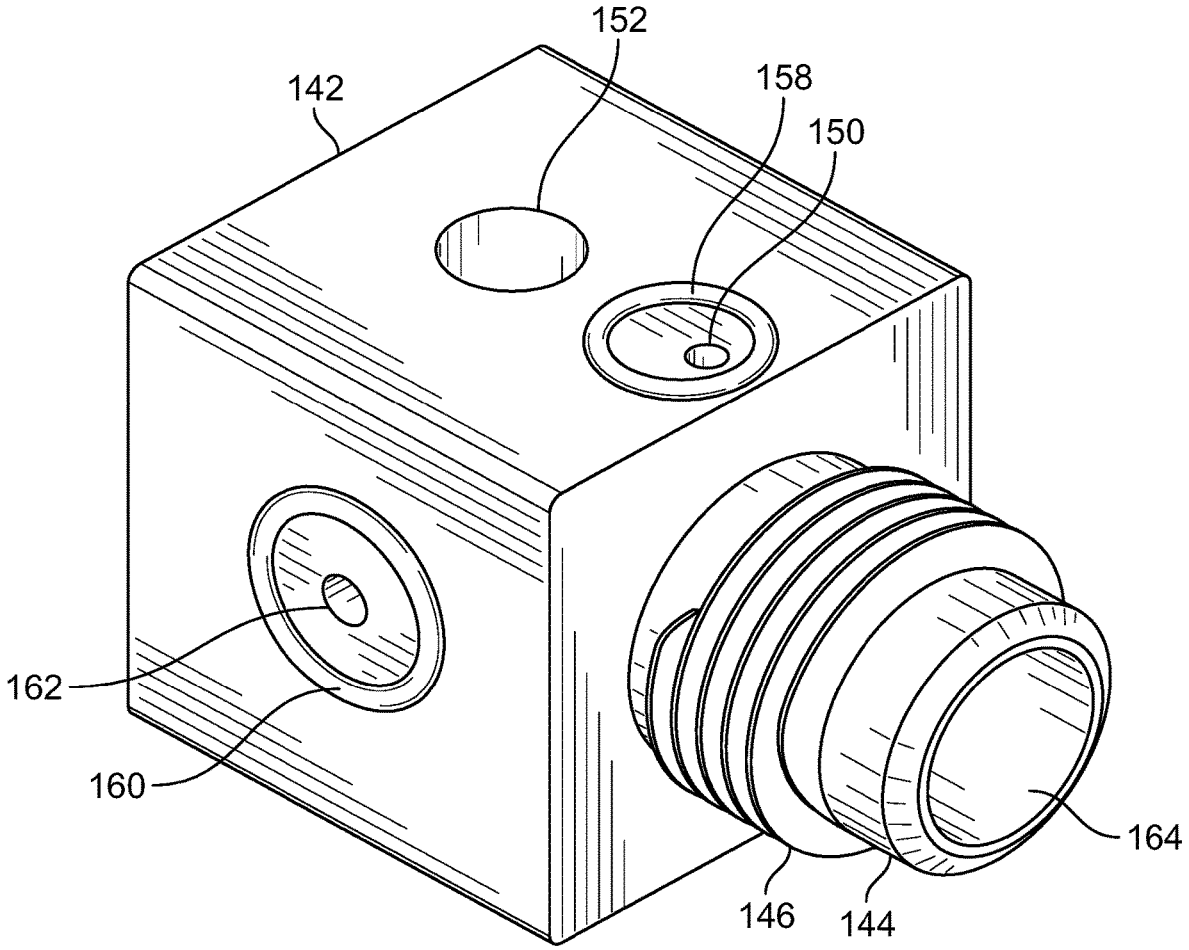
FIG. 7 illustrates a perspective view of an embodiment of a housing according to this disclosure.
Figure 8:
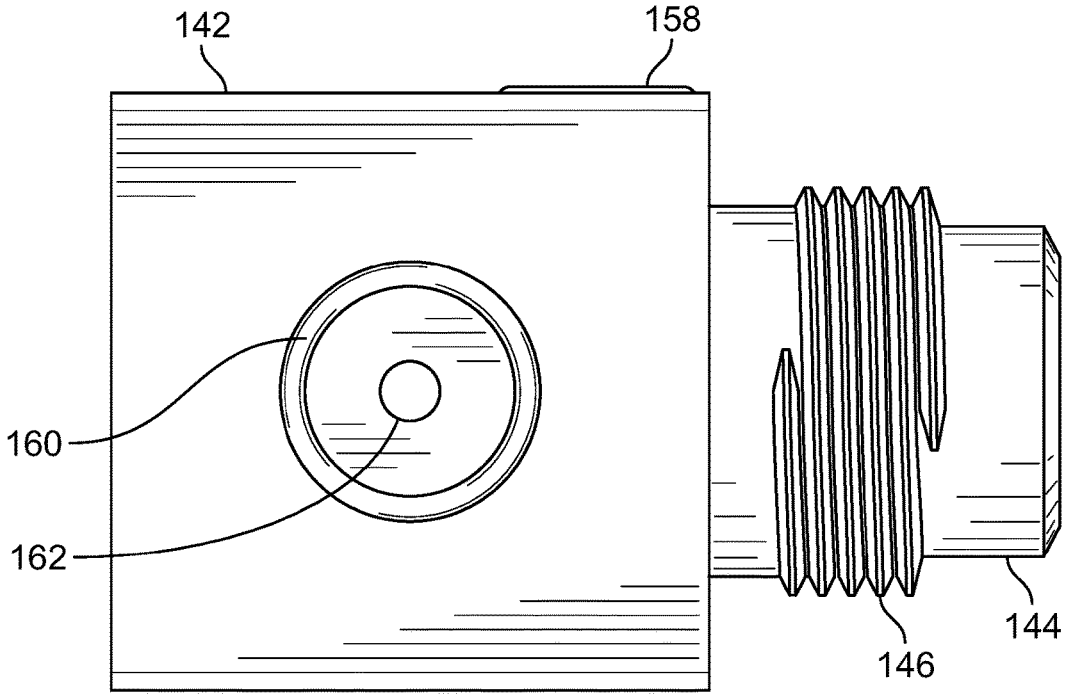
FIG. 8 illustrates a right side view of an embodiment of a housing according to this disclosure.
Figure 9:
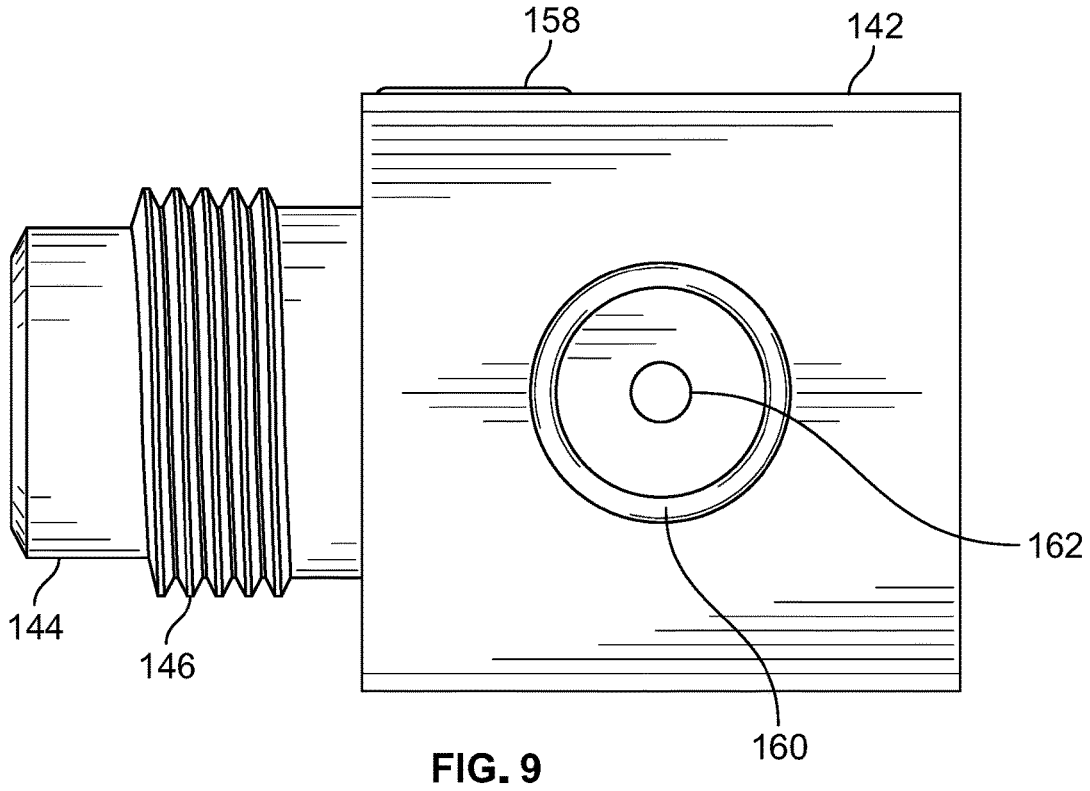
FIG. 9 illustrates a left side view of an embodiment of a housing according to this disclosure.
Figure 10:
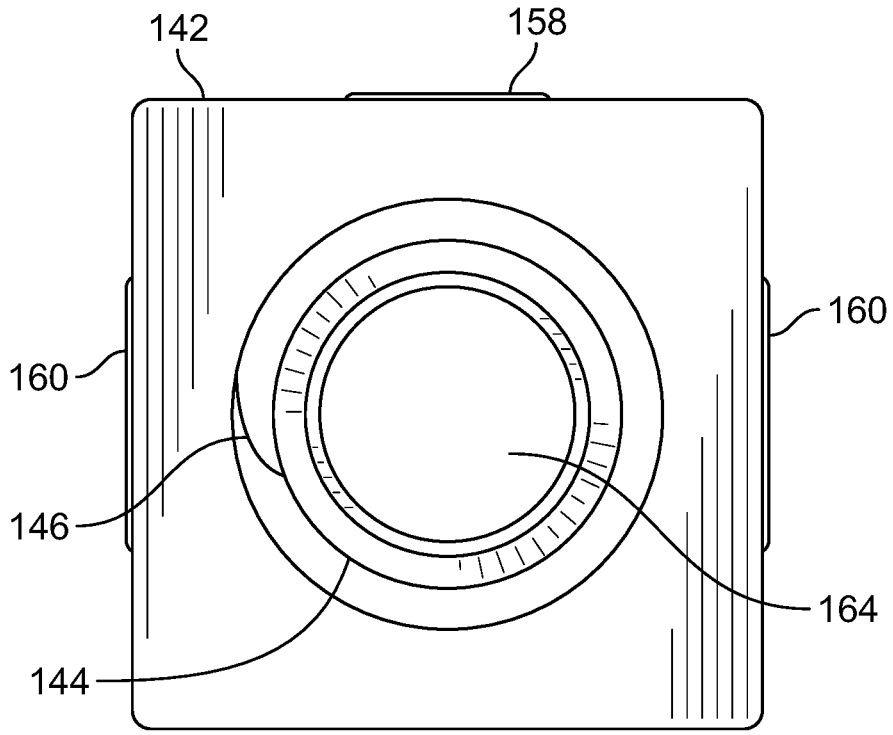
FIG. 10 illustrates a front view of an embodiment of a housing according to this disclosure.
Figure 11:
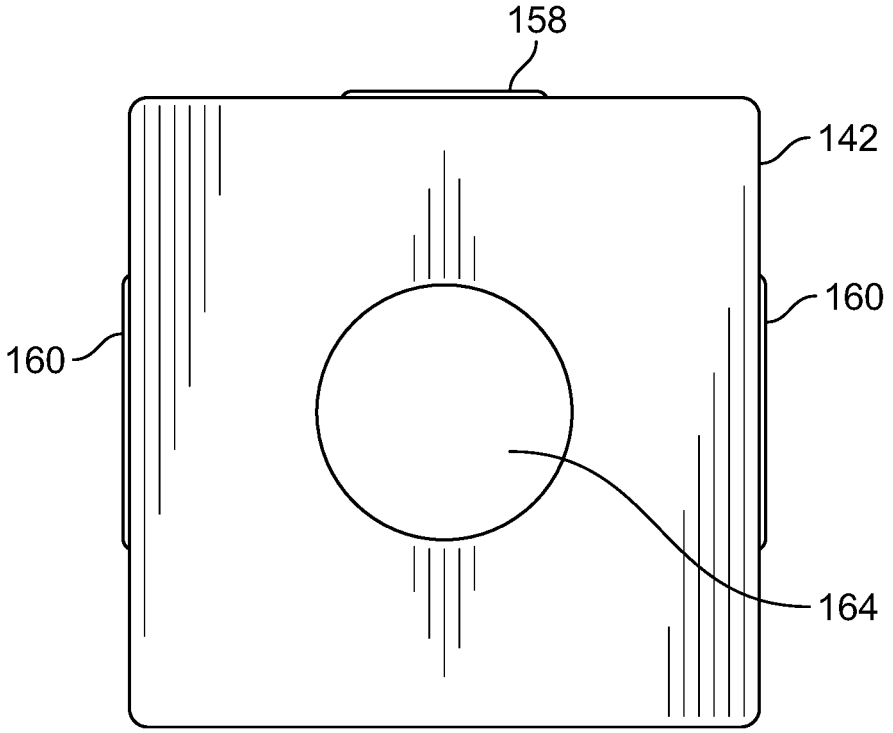
FIG. 11 illustrates a back view of an embodiment of a housing according to this disclosure.
Figure 12:
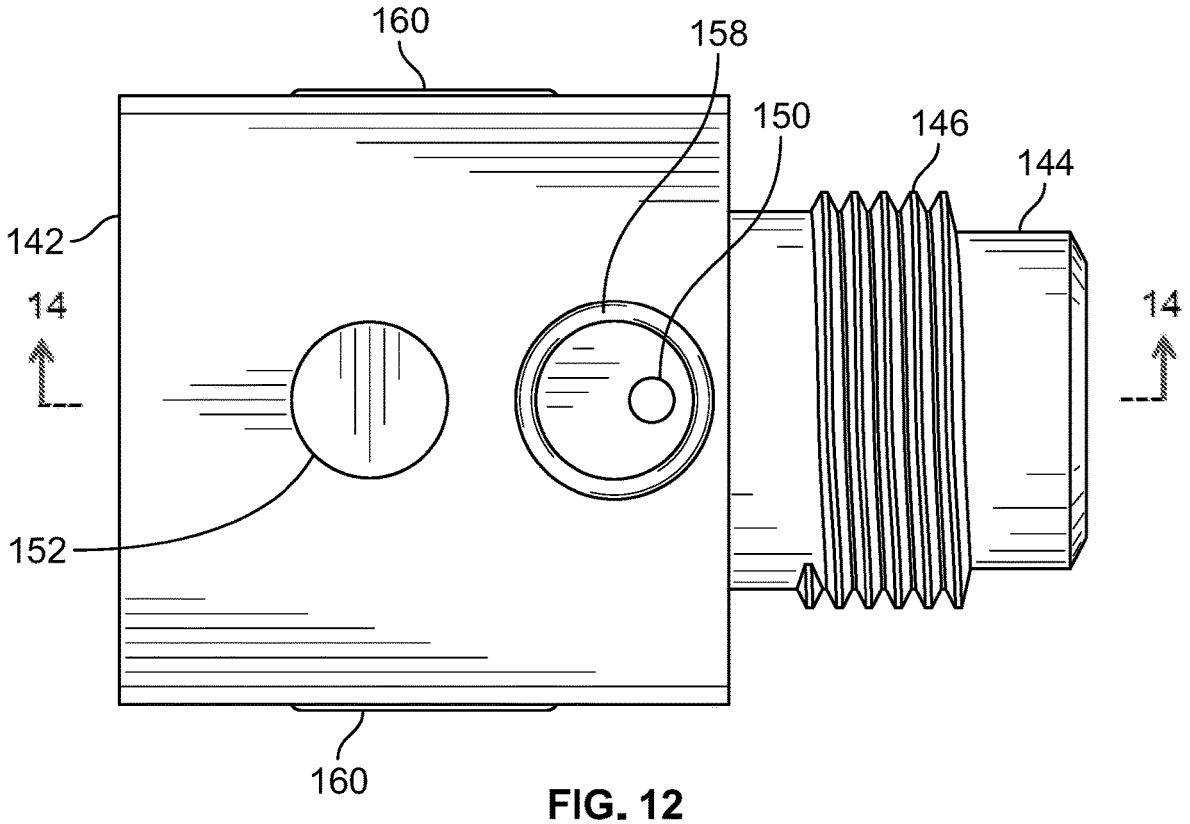
FIG. 12 illustrates a top view of an embodiment of a housing according to this disclosure.
Figure 13:
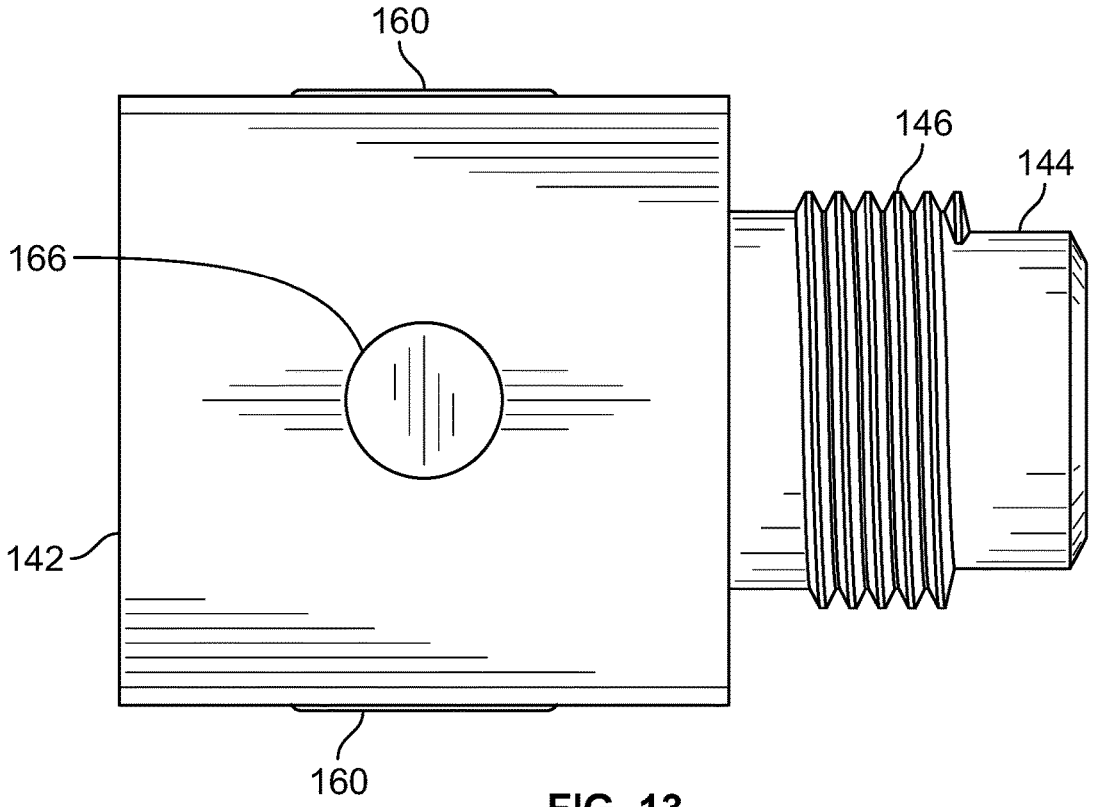
FIG. 13 illustrates a bottom view of an embodiment of a housing according to this disclosure.
Figure 14:
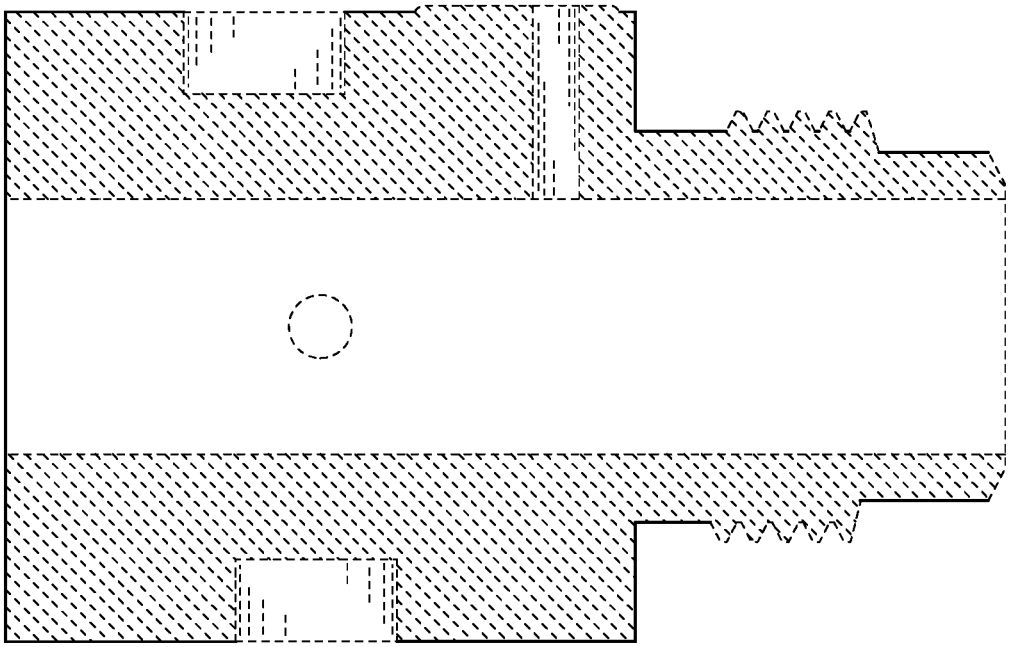
FIG. 14 illustrates a cross-sectional view of an embodiment of a housing according to this disclosure.

FIG. 7 illustrates a perspective view of an embodiment of a housing according to this disclosure. FIG. 8 illustrates a right side view of an embodiment of a housing according to this disclosure. FIG. 9 illustrates a left side view of an embodiment of a housing according to this disclosure. FIG. 10 illustrates a front view of an embodiment of a housing according to this disclosure. FIG. 11 illustrates a back view of an embodiment of a housing according to this disclosure. FIG. 12 illustrates a top view of an embodiment of a housing according to this disclosure. FIG. 13 illustrates a bottom view of an embodiment of a housing according to this disclosure. FIG. 14 illustrates a cross-sectional view of an embodiment of a housing according to this disclosure. In particular, the housing 142 includes the upper well 152, the fluid channel 150, a fluid gasket ring 158, a plurality of composition gasket rings 160, a plurality of composition channels 162, a cavity 164, and a lower well 166. The upper well 152 avoids fluid communication with the interior chamber 148 and is configured to receive the projection from the cover 116 in order to secure the housing 142 within the body 102 when the cover 116 is coupled to the body 102. The fluid channel 150 is in fluid communication with the interior chamber 148 and with the L-shaped tube assembly 118 when the cover 116 is coupled to the body 102. The fluid gasket ring 158, which is O-shaped but can vary, is configured to engage with the cover 116 when the cover 116 is coupled to the body 102. Although the fluid gasket ring 158 is circular, this shape can vary, such as square, rectangular, triangular, pentagonal, hexagonal, or others. The composition gasket rings 160, which are O-shaped, but can vary, oppose each other on the housing 142 and are configured to engage with the body 102 in proximity of the tube assemblies 110. Although the composition gasket ring 160 is circular, this shape can vary, such as square, rectangular, triangular, pentagonal, hexagonal, or others. The composition channels 162 oppose each other in the housing 142 and are in fluid communication with the interior chamber 148 and the tube assemblies 110. The composition channels 162 are not offset and are co-aligned with each other. In some embodiments, the composition channels 162 are offset and are not co-aligned with each other. Although the composition channels 162 are longitudinally rectilinear, this configuration can vary, such as via being longitudinally sinusoidal, arcuate, or others, whether identical to or different from each other in any physical dimensions, sizes, shapes, surfaces, or others, such as diameter, surface smoothness/roughness, or others. The housing 142 contains the cavity 164 that extends within the housing 142 and the tube 144, thereby including the inner chamber 148. The lower well 166 avoids fluid communication with the interior chamber 148 and is configured to receive a projection from the body 102 in order to secure the housing 142 within the body 102. Although the upper well 152 and the lower well 166 are offset and are not co-aligned with each other, in some embodiments, the upper well 152 and the lower well 166 are not offset and are co-aligned with each other.

In some embodiments, the foam output device can be embodied as a turreted cannon, a hose adapter, an aerosol can. For example, the cannon can be mounted on a vehicle, such as via the platform 108, such as a fire fighting vehicle, whether land, marine, or aerial, whether manned or unmanned. For example, the hose adapter can be configured to mount onto a fluid hose, such as a gas hose, such as an air hose or others, such that the adapter can receive the compositions and the foam can be formed therein. For example, the aerosol can may contain a plurality of chemical composition chambers and a fluid chamber.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Various terminology used herein is for describing particular example embodiments and is not intended to be necessarily limiting of this disclosure. As used herein, various singular forms "a," "an" and "the" are intended to include various plural forms as well, unless a context clearly indicates otherwise. Various terms "comprises," "includes" and/or "comprising," "including" when used in this specification, specify a presence of stated features, integers, steps, operations, elements, and/or components, but do not preclude the presence and/or addition of one or more other features, integers, steps, operations, elements, components, and/or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Features described with respect to certain example embodiments can be combined and sub-combined in and/or with various other example embodiments. Also, different aspects and/or elements of example embodiments, as disclosed herein, can be combined and sub-combined in a similar manner as well. Further, some example embodiments, whether individually and/or collectively, can be components of a larger system, wherein other procedures can take precedence over and/or otherwise modify their application. Additionally, a number of steps can be required before, after, and/or concurrently with example embodiments, as disclosed herein. Note that any and/or all methods and/or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques and/or tolerances, are to be expected. Thus, various example embodiments of this disclosure should not be construed as necessarily limited to various particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, plastic, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized and/or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" and/or "substantially" refers to a +/−10% variation from a nominal value/term. Such variation is always included in any given value/term provided herein, whether or not such variation is specifically referred thereto.

If any disclosures are incorporated herein by reference and such disclosures conflict in part and/or in whole with this disclosure, then to an extent of a conflict, if any, and/or a broader disclosure, and/or broader definition of terms, this disclosure controls. If such disclosures conflict in part and/or in whole with one another, then to an extent of a conflict, if any, a later-dated disclosure controls.

In some embodiments, various functions or acts can take place at a given location and/or in connection with the operation of one or more apparatuses or systems. In some embodiments, a portion of a given function or act can be performed at a first device or location, and a remainder of the function or act can be performed at one or more additional devices or locations.

Various corresponding structures, materials, acts, and equivalents of all means or step plus function elements in various claims below are intended to include any structure, material, or act for performing the function in combination with other claimed elements as specifically claimed. Various embodiments were chosen and described in order to best explain various principles of this disclosure and various practical applications thereof, and to enable others of ordinary skill in a pertinent art to understand this disclosure for various embodiments with various modifications as are suited to a particular use contemplated.

Various diagrams depicted herein are illustrative. There can be many variations to such diagrams or steps (or operations) described therein without departing from various spirits of this disclosure. For instance, various steps can be performed in a differing order or steps can be added, deleted or modified. All of these variations are considered a part of this disclosure. People skilled in an art to which this disclosure relates, both now and in future, can make various improvements and enhancements which fall within various scopes of various claims which follow.

This detailed description has been presented for various purposes of illustration and description, but is not intended to be fully exhaustive and/or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. A scope of this disclosure is defined by various claims, which include known equivalents and unforeseeable equivalents at a time of filing of this disclosure.

The invention claimed is:

1. A dispenser comprising:

a mixing valve configured to switch between a first mode and a second mode, wherein the mixing valve is configured to simultaneously receive a plurality of compositions and a fluid during the first mode such that the compositions and the fluid are able to react with each other within the mixing valve to form a compound thereby, wherein the mixing valve is configured to prevent the compositions and the fluid from reacting with each other in the mixing valve during the second mode, the mixing valve including a housing defining a chamber configured to receive the plurality of compositions and the fluid during the first mode, and a first channel, a second channel, and a third channel in fluid communication with the chamber, wherein the first channel is configured to direct a first composition of the plurality of compositions into the chamber, the second channel is configured to direct a second composition of the plurality of compositions into the chamber, and the third channel is configured to direct the fluid into the chamber, and a plunger in the housing and configured to move between a first position in the first mode and a second position in the second mode, wherein the plunger allows the compositions and the fluid to react within the chamber when the plunger is at the first position during the first mode, wherein the plunger prevents the compositions and the fluid from reacting with each other in the chamber when the plunger is at the second position during the second mode; and a solenoid valve fixedly coupled to the plunger, wherein the solenoid valve is configured such that movement of the solenoid valve imparts movement of the plunger to the first position in the first mode and the second position in the second mode, wherein in the first position the plunger is un-deployed, in a direction toward the solenoid valve, wherein in the second position the plunger is deployed, in a direction away from the solenoid valve.

2. The dispenser of claim 1, wherein the dispenser includes a trigger operatively coupled to the solenoid valve to switch the mixing valve between the first mode and the second mode.

3. The dispenser of claim 1, further comprising a body, a first tube assembly, a second tube assembly, a first tube valve and a second tube valve, wherein the body houses the mixing valve, wherein the mixing valve is distinct from the first tube valve and the second tube valve, wherein the first tube assembly and the second tube assembly are in fluid communication with the mixing valve, wherein the first tube assembly is coupled to the body and the second tube assembly is coupled to the body such that the first tube assembly and the second tube assembly are external to the body, wherein the first tube valve is coupled to the first tube assembly external to the body and the second tube valve is coupled to the second tube assembly external to the body, wherein the first tube assembly is configured to direct the first composition to the mixing valve and the second tube assembly is configured to direct the second composition to the mixing valve.

4. The dispenser of claim 3, wherein the body houses the mixing valve such that the mixing valve is positioned between the first tube assembly and the second tube assembly.

5. The dispenser of claim 3, wherein the dispenser includes an L-shaped tube assembly coupled to the body, wherein the L-shaped tube assembly is configured to direct the fluid to the mixing valve.

6. The dispenser of claim 5, wherein the L-shaped tube assembly is coupled to the body between the first tube assembly and the second tube assembly.

7. The dispenser of claim 1, wherein the housing is shaped as at least one of a pyramid, a wedge, a sphere, an ellipsoid, or an ovoid.

8. The dispenser of claim 1, wherein the housing is shaped as a polyhedron.

9. The dispenser of claim 8, wherein the housing is shaped as at least one of a cube or a cuboid.

10. The dispenser of claim 1, further comprising a tube extending away from the housing, wherein the compound exits the housing via the tube.

11. The dispenser of claim 10, wherein the tube includes a threaded portion.

12. The dispenser of claim 11, further comprising a barrel coupled to the tube via the threaded portion.

13. The dispenser of claim 12, wherein the barrel contains an auger which self-propels the compound in a direction away from the housing.

14. The dispenser of claim 10, wherein the housing and the tube are unitary.

15. The dispenser of claim 14, wherein the housing and the tube include a same material.

16. The dispenser of claim 10, wherein the tube is in fluid communication with the chamber.

17. The dispenser of claim 1, wherein the dispenser is a gun.

18. The dispenser of claim 1, wherein the compound is in a foam form.

19. A method of dispensing a compound from the dispenser of claim 1, the method comprising:

one of activating or deactivating the solenoid valve of the dispenser to move the solenoid valve;

imparting, via the movement of the solenoid valve, movement of the plunger of the mixing valve, relative to the chamber of the mixing valve, from the second position in the second mode to the first position in the second mode, whereby upon said moving of the plunger, the plurality of compositions and the fluid are directed into the chamber such that the compositions and the fluid are able to react with each other within the chamber to form the compound; and outputting the compound from the chamber.

20. The method of claim 19, further comprising:

receiving the compound from the chamber;

inserting the compound into a tube containing an auger, wherein the dispenser includes the tube; and operating the auger such that the compound is output from the tube.

21. The method of claim 19, wherein the dispenser is a gun.

22. The method of claim 19, wherein the compound is in a foam form.

23. The dispenser of claim 1, wherein the plunger is movable, via the solenoid valve, from inside the chamber to outside the chamber when the plunger is moved from the second position to the first position.

* * * * *